United States Patent [19]

Lee et al.

[11] Patent Number: 4,530,265

[45] Date of Patent: Jul. 23, 1985

[54] ROTARY CUTOFF KNIFE

[75] Inventors: Frank X. Lee, New York; Leonard C. Krimsky, Spring Valley; Henk Van Rietschoten, Monroe, all of N.Y.

[73] Assignee: Worldwide Converting Machinery, Inc., Allendale, N.J.

[21] Appl. No.: 438,762

[22] Filed: Nov. 3, 1982

[51] Int. Cl.[3] ..... B26D 1/56

[52] U.S. Cl. ..... 83/337; 83/298; 83/327; 83/328; 242/56 R; 242/56 B

[58] Field of Search ..... 83/298, 310, 327, 328, 83/345, 285, 337; 242/56 B, 56 R

[56] References Cited

U.S. PATENT DOCUMENTS 3,956,955 5/1976 Marritt ..... 83/328 X 4,122,738 10/1978 Granger ..... 83/337

4,226,149 10/1980 Feldkamper et al. ..... 83/328 X

*Primary Examiner*—Donald R. Schran

*Attorney, Agent, or Firm*—Shenier & O'Connor

[57] ABSTRACT

An improved rotary knife assembly for severing a moving web in which a support is mounted on a frame for rotary movement around a first axis, and a knife blade is mounted on the support for rotary movement around a second axis generally parallel to and spaced from the first axis. The knife blade is adapted to move from a first position remote from the web to a second position at which it engages and severs the web. Means are provided for concomitantly driving the support and the blade around the axes to move the blade from the first position through the second position and back to the first position.

6 Claims, 7 Drawing Figures

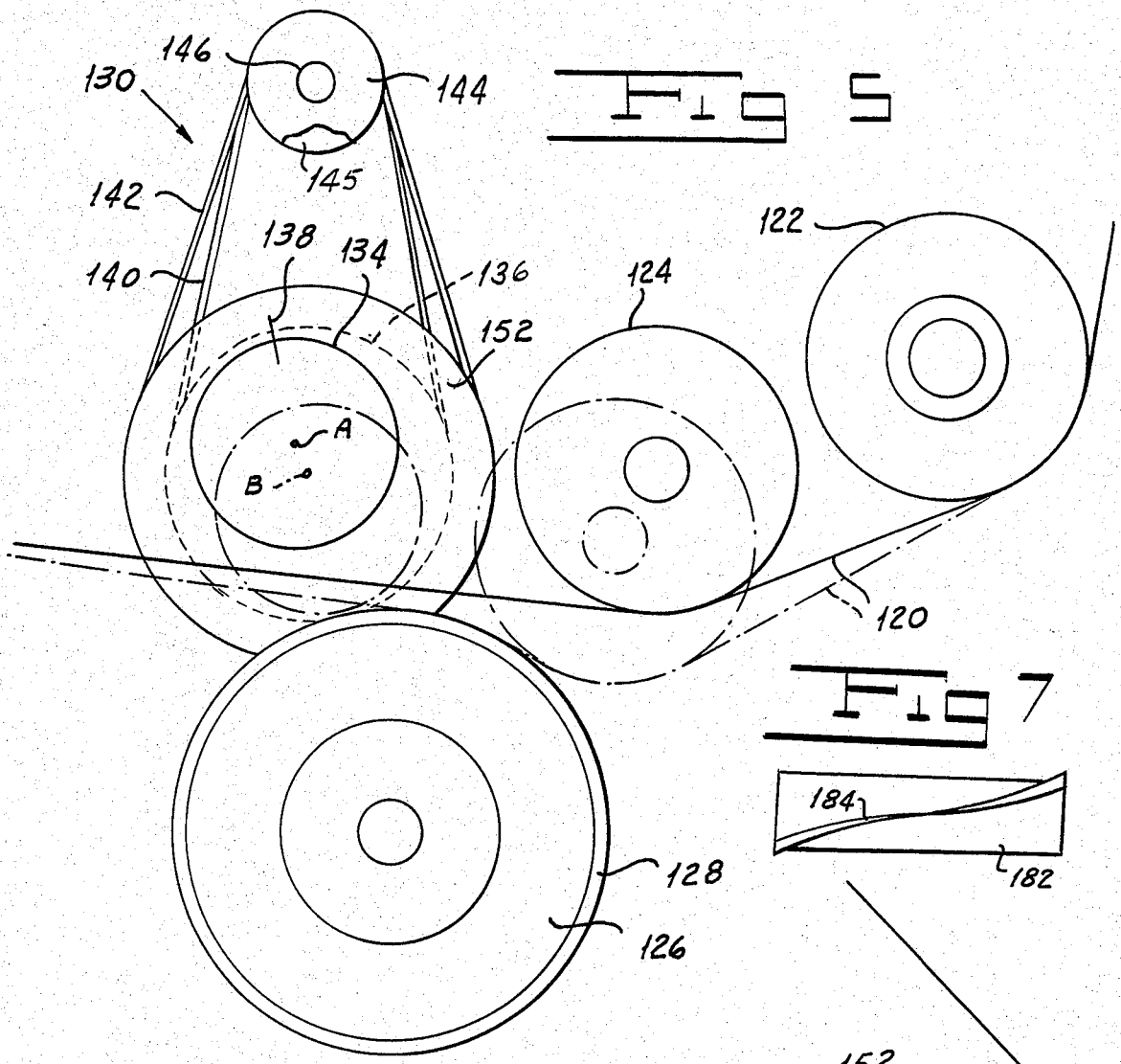
Fig 5
Fig 7
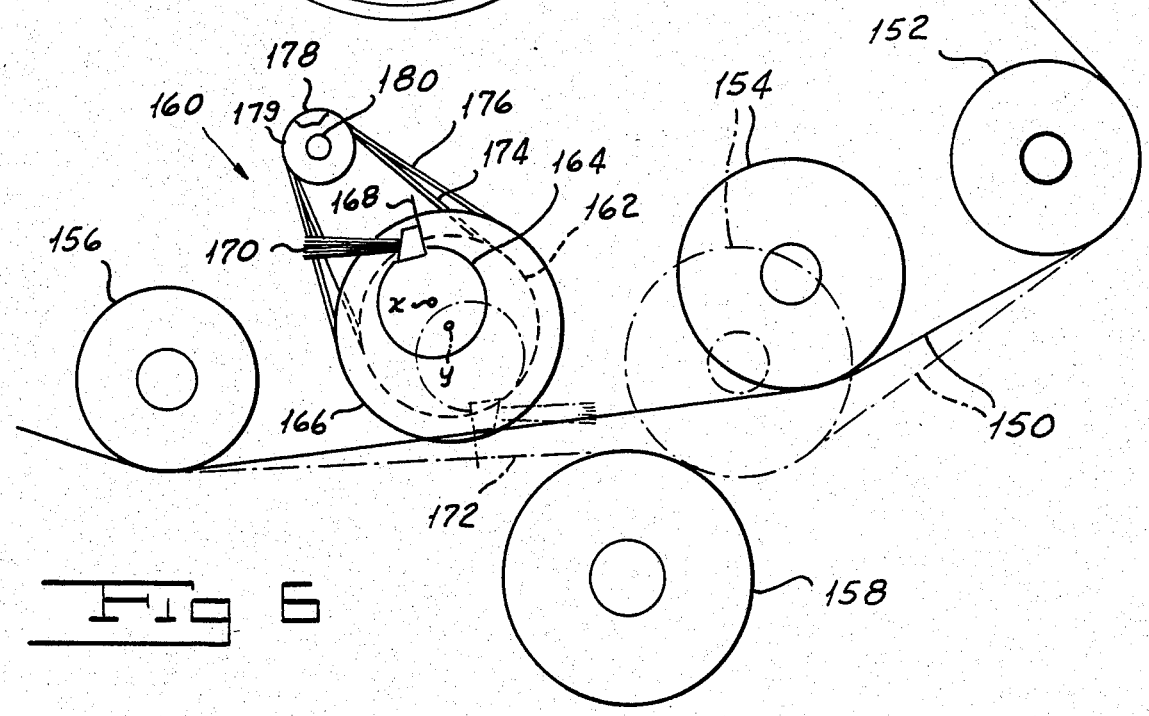
Fig 6

ROTARY CUTOFF KNIFE

FIELD OF THE INVENTION

Our invention relates to a rotary knife for cutting a moving web of material.

BACKGROUND OF THE INVENTION

Rotary knives have various applications in continuous processes of treating or otherwise working with moving webs. For example, in an automatic transfer mechanism for a continuous winding operation, the web must be severed at a location between the new core and the full winding roll. This immediately produces a "tail" which must quickly wrap around the surface of the new core if a fold-over of the tail is to be avoided. A tail fold-over produces a bump which lasts for many wraps and which can damage the material in these wraps.

To ensure that the tail catches up with the surface of the new core so as to avoid fold-over, it is necessary that the knife fire in close proximity to the core and that the knife travel at a velocity greater than web speed. For slow web speeds, conventional cutoff knives can be fired by pneumatic or hydraulic cylinders. To achieve higher knife speeds, however, a rotary knife and one of the single revolution type is used in order to make only one cut. Rotary knives of the prior art must either be of a large diameter, which interferes with access to the core, or must employ a large drive motor and drive transmission components to achieve extremely high acceleration and deceleration rates.

A compound motion device has also been suggested wherein the knife accelerates to top speed and then swings into the cutting position. In such an arrangement the swinging device becomes a problem since a knife of reasonably small diameter makes one revolution in a very short time. The inertia of the pivoting knife about the pivot axis is very high. It also requires large components which interfere with the new core.

An alternative method for avoiding tail fold back is a die cut arrangement in which a steel rule type die is employed and in which the core is used as a platen so as to eliminate the tail in the first place. While this system is satisfactory for many installations, not all cores can be used as platens and for high web speeds it is difficult to get the knife in and out of the cutting position quickly.

In addition to the cutting situations outlined above, there exists the situation in which it is desirable to eliminate an overlapping type splice of a new roll to an expiring roll made in the course of an unwinding operation and to replace the lap splice with a butt splice. In one method of the prior art of splicing a new roll to an expiring roll in the course of an unwinding operation, the web is stopped by the use of accumulators and a zero speed butt splice is made directly on the web ends. The accumulators are very expensive and occupy a great deal of space on the line.

In a second method of butt splicing in an unwinding operation, a previously formed lap splice is cut out and the web ends are butt spliced at line speed. This method normally involves the use of a die type cutter set on a rotary armature. The cut is almost perpendicular to the direction of web travel and high stress is put on the splice as it travels through the process.

SUMMARY OF THE INVENTION

One object of our invention is to provide a rotary knife which does not require large drive motor and drive transmission components.

Another object of our invention is to provide a rotary knife which uses less power to accelerate and to move into the cutting position than do rotary knives of the prior art.

Still another object of our invention is to provide a rotary knife which is smaller in size than those of the prior art.

A further object of our invention is to provide a rotary knife which is capable of achieving higher speeds than those of the prior art.

Yet another object of our invention is to provide an improved rotary knife adapted to cut against a soft core without the danger of gouging.

Another object of our invention is to provide a rotary knife capable of producing a cut which is not perpendicular to the direction of web travel, thereby easing the stress on a splice as it travels through the process.

A still further object of our invention is to provide a rotary knife which may be readily adapted for use in various applications.

Other and further objects will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 5 is a schematic view of a "die-cut" transfer system in which our rotary cutoff knife can be employed.

FIG. 6 is a schematic view of a "flying" transfer system in which our rotary cutoff knife can be employed.

FIG. 7 is an elevation of an alternate embodiment of our rotary cutoff knife.

DESCRIPTION OF THE PREFERRED EMBODIMENT

It is to be understood that our apparatus may be used to cut a moving web both in a web winding operation in which the web is to be transferred from a full core to an empty core and in an unwinding operation in which the tail of an expiring web is severed at the end of the operation and spliced to a new web.

Figure 1:
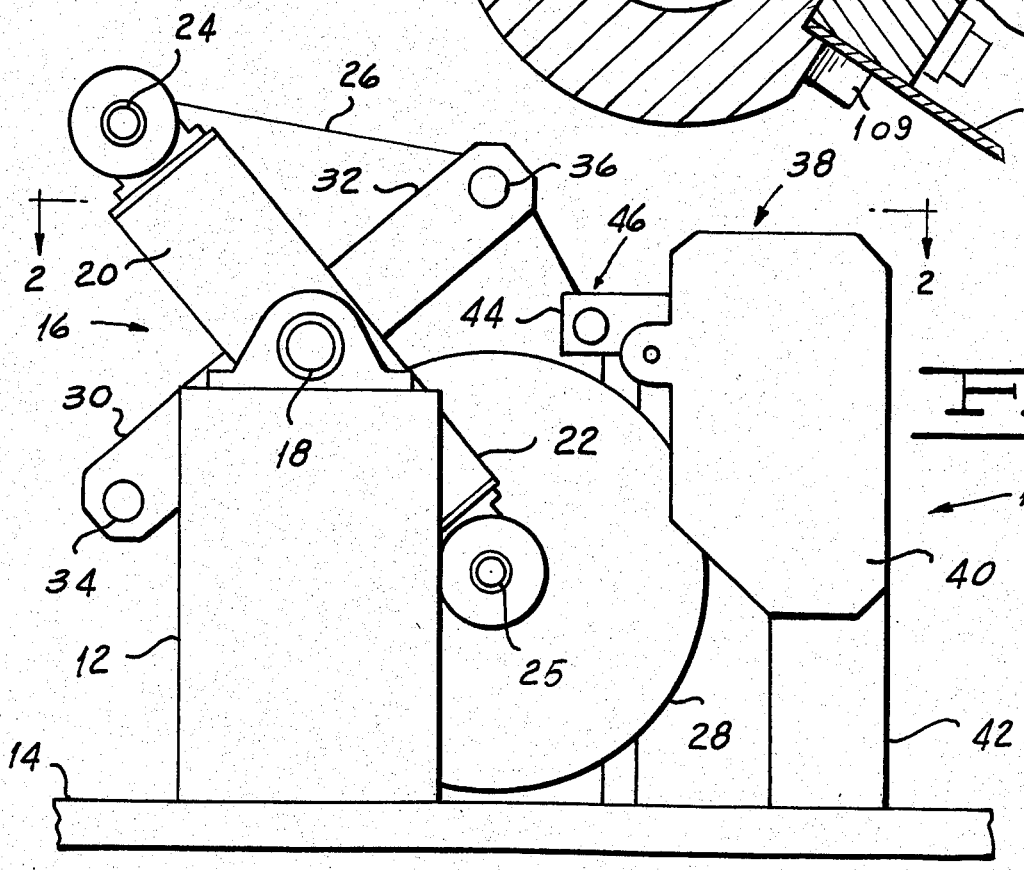
FIG. 1 is a front elevation of a roll unwinding stand and web splicing apparatus incorporating our rotary knife.

Referring now to FIG. 1, a web splicing apparatus, such for example as that described in Lee et al U.S. Pat. No. 3,944,151, and indicated generally by the reference character 10, with which our rotary cut off knife may be used, includes a roll unwinding stand 12 supported on a floor 14. The stand 12 rotatably carries a turret 16 having a shaft 18. The turret includes two pairs of oppositely extending arms 20 and 22, carrying respective roll-supporting spindles 24 and 25. By way of example, the spindle 24 on arms 20 may support the roll carrying the expiring web 26, while the spindle 25 on arms 22 may support the roll carrying the fresh or new web 28. Turret 14 includes two other pairs of oppositely extending arms 30 and 32, carrying respective idler rolls 34 and 36.

A splicing unit 38 includes a frame 40 supported on an upright 42 adjacent to the stand 12. As more fully described in Lee et al, the unit permits the splicing of the trailing end of the expiring roll 26 to the leading end of the fresh or new roll 28. This requires passing a knife through the web at the correct angular orientation to sever the trailing end of the expiring web. The splicing unit 40 has an arm 44 which supports our rotary cut off knife, indicated generally by the reference character 46.

Figure 2:
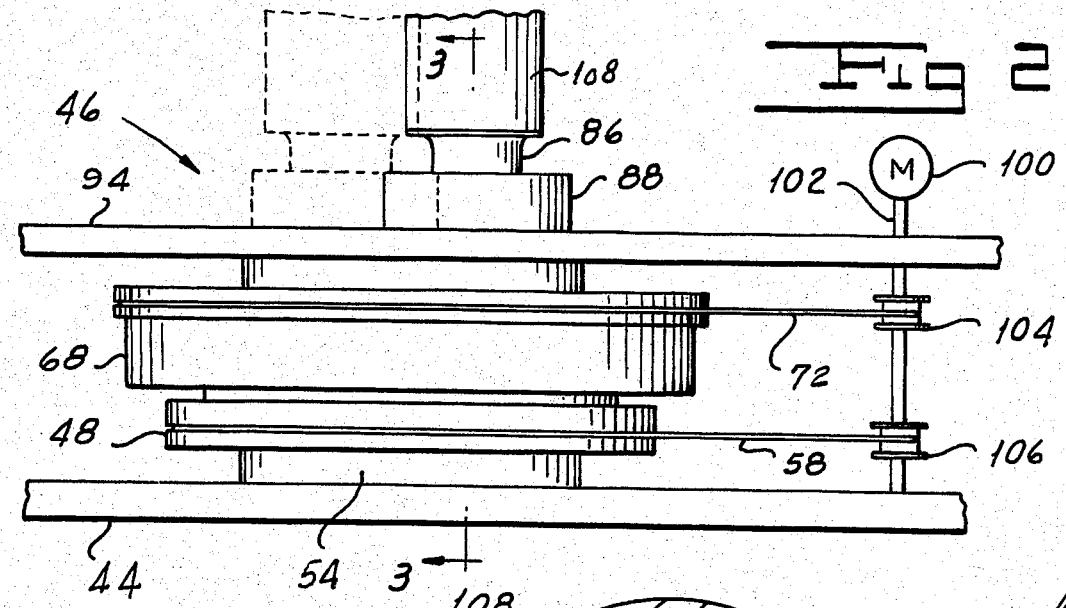
FIG. 2 is a fragmentary top plan of our rotary knife taken along the lines 2—2 of FIG. 1 and drawn on an enlarged scale.
Figure 4:
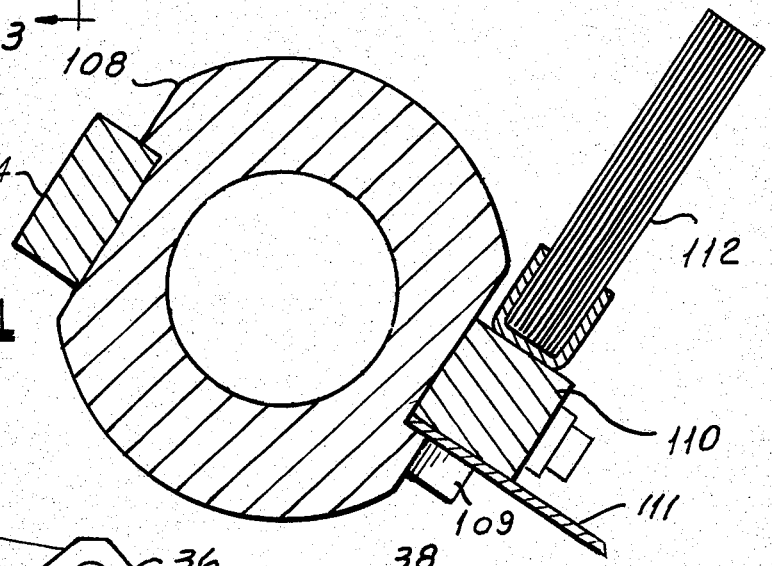
FIG. 4 is a section of the knife bar assembly of our rotary knife taken along the lines 4—4 of FIG. 3.
Figure 3:
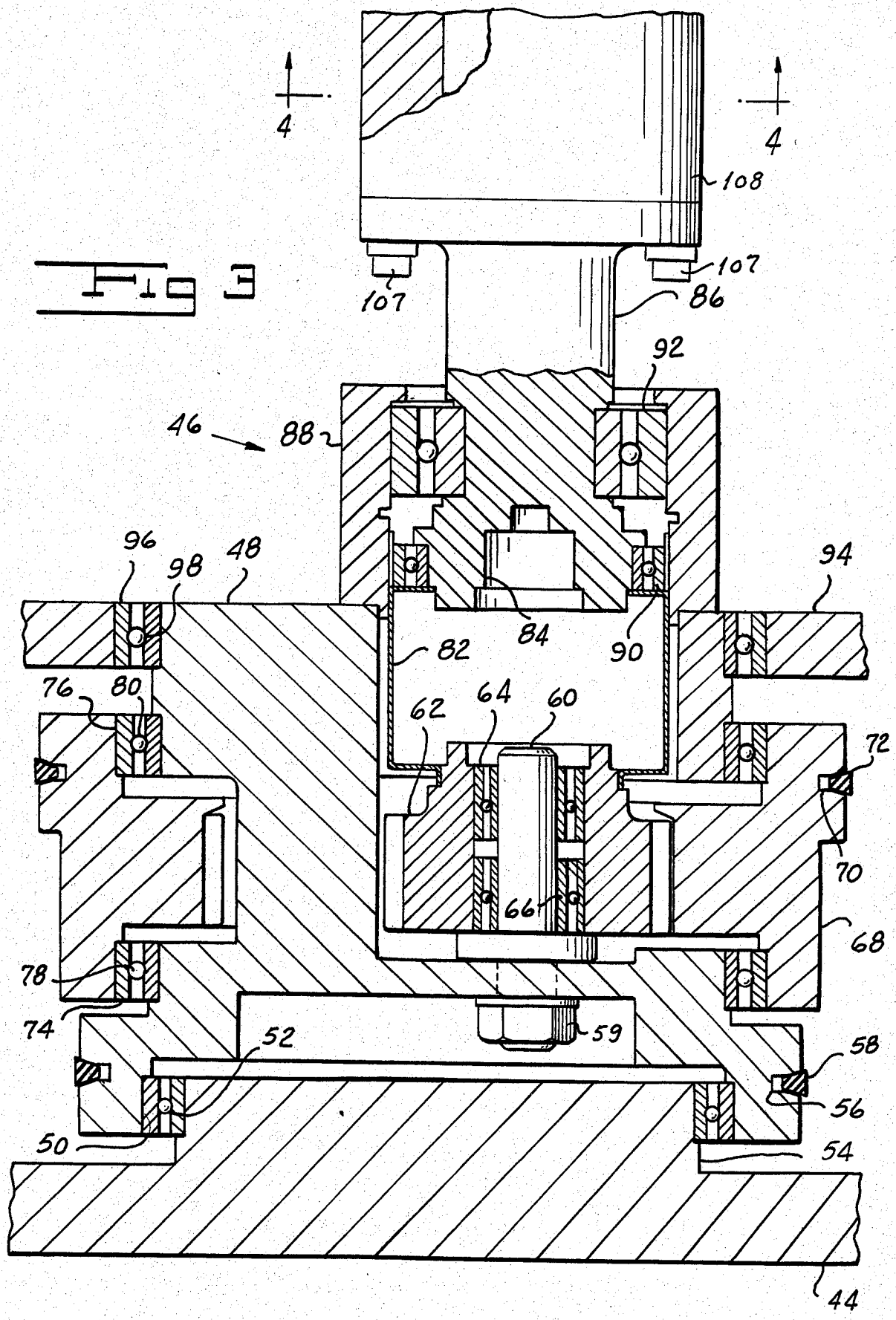
FIG. 3 is a fragmentary section of our rotary knife taken along the lines 3—3 of FIG. 2 and drawn on an enlarged scale.

Referring now to FIGS. 2 to 4, our improved rotary cutting knife 46 includes a crank or eccentric 48 rotatably mounted on a boss 54 on arm 44 by means of a bearing 52 received in a recess 50 in eccentric 48. We form eccentric 48 with a peripheral pulley groove 56 which receives a driving belt 58 for rotating the eccentric 48 around the axis of bearing 52. Any suitable means such as a nut 59 secures a stub shaft 60 to the eccentric 48, with the axes of bearing 52 and shaft 60 generally parallel and spaced by a predetermined distance.

A pinion 62 is rotatably supported on shaft 60 by means of a pair of spaced bearings 64 and 66. Pinion 62 engages an internal ring gear 68 rotatably supported on eccentric 48 by spaced bearings 74 and 76 having rolling elements 78 and 80. We form ring gear 68 with an outer peripheral pulley groove 70 for receiving a driving belt 72. A flexible coupling 82 connects pinion 62 to one end 84 of the knife bar hub 86. Spaced bearings 90 and 92 in a housing 88 on eccentric 48 rotatably support the hub 86. A frame member 94 carries a bearing 96 having rolling elements 98. It will readily be appreciated that the bearings 52 and 96 carried respectively by arm 44 and by frame member 94 cooperate to support the eccentric 48 for rotary movement around a first axis while bearings 90 and 92 support the knife bar hub 86 on eccentric 48 for rotary movement around a second axis generally parallel to and spaced from the first axis.

A motor 100 is adapted to drive a shaft 102 rotatably supported in arm 44 and in frame member 94. Pulleys 104 and 106 carried by shaft 102 for rotation therewith are adapted to drive belts 72 and 58 in synchronism.

We employ any suitable means such as bolts 107 or the like to secure the knife bar 108 to a flange on the outer end of hub 86. We secure a knife support 110 in a flat formed in the outer surface of bar 108. Screws 109 attach the knife blade 111 to support 110. In one application of our knife we weld or otherwise mount a brush holder carrying a brush 112 to the side of support 110 remote from that to which the blade 111 is attached. A counterweight 114 secured to a flat formed in the outer surface of the knife bar 108 opposite the knife support 110, serves to balance the bar 108. It will readily be appreciated that the type of blade 111 used as well as the specific bar assembly employed is determined by the operation to be performed.

In the first application of our improved rotary knife the web is to be cut at a location at which it is unsupported to produce a tail which, in an unwinding operation, is to be spliced to the beginning of a new roll or in a winding operation is to be adhered to a core.

Normally the knife bar 46 is held in its disengaged or retracted position, as indicated by the solid lines in FIG. 2. When the web 26 is to be cut, motor 100 is energized, rotating shaft 102. Pulleys 104 and 106 drive belts 72 and 58, causing the synchronized rotation of both the crank 48 and the ring gear 68. Ring gear 68 drives pinion 62 which causes knife bar 108 to rotate on an axis extending through the center of the stub shaft 60. This knife assembly is simultaneously moved from the retracted position to the engaged position as indicated by the dotted lines in FIG. 2 by the smooth slow rotation of the crank 48, which results in movement of the stub shaft 60 and knife bar along the circumference of a circle having its center at the axis of rotation of the crank 48.

When the knife bar 86 has reached the "engage" or "cut" location, a point approximately halfway along the circumference of the circle having the center of the crank 48 as its center, the knife 111 makes a single cut through the web 26 and the knife bar 86 continues along the circumference of the circle, returning to its retracted position.

It will readily be appreciated that if the ratio between the crank 48 and knife bar 86 is twenty to one, then, from the retracted position to the engaged position, the knife bar can be allowed ten revolutions in order to accelerate to match the speed of the web 26. Since this is pure rotary motion of a balanced mass and a ten fold time increase is provided, the horsepower necessary to accelerate the knife is greatly reduced from that required in systems of the prior art. In addition, the power necessary to move the crank 48 is reduced, because the mass of the knife bar is moving slowly about the axis of the stub shaft 60 and is rotating on a short radius arm, thereby reducing inertia.

Selection of the proper ratio between crank 48 rotary speed and knife bar rotary speed allows the knife to accelerate, move to the engaged position, cut the web 26 and retract with low power consumption and low component cost.

As has been pointed out hereinabove, our improved rotary knife is useful in winding operations in which a continuous web being wound is to be transferred from a full core to an empty core on a winding stand similar to the unwinding stand shown in FIG. 1. This operation may, moreover, be performed by cutting the web at a location at which it is unsupported to produce the tail discussed hereinabove or by cutting the web against the new core to eliminate the tail entirely.

Referring now to FIG. 6, a flying transfer mechanism for use in a continuous winding operation which may also employ my rotary knife includes a web 150 which is passed around a stationary guide roller 152, a movable bumper roll 154, and a guide roll 156 to a winding roll, not shown. A new core 158 is prepared for transfer and disposed below the web 150, and our rotary cutoff knife, indicated generally by the reference character 160 is disposed above the web.

Knife 160 includes a crank 162 upon which a knife bar 164 is mounted and an internal ring gear 166. For cutting in air on a flying transfer winder the knife bar 164 may include both a blade 168 to cut the web between the new core 158 and the full roll, and a brush 170 to ensure that the tail 172 (that portion of the web 150 between the new core 158 and the full roll) does not fold back on itself, but adheres to the new core 158. It should be noted that this type of knife bar arrangement is shown in greater detail in FIG. 4.

The crank 162 and ring gear 166 are adapted to be simultaneously rotated by respective belts 174 and 176 which are driven by pulleys 178 and 179 mounted on a shaft 180 connected to a suitable motor, not shown.

When the winding roll is full, the new core 158 is accelerated to match the speed of the web 150 and the bumper roll 154 is fired, moving from its normal position to the position indicated by the dot-dash lines to bring the web 150 into contact with the core 158. The rotary knife motor is energized, driving belts 174 and 176 to simultaneously rotate both the crank 162 and the internal ring gear 166.

In response, knife bar 164 begins to rotate on axis X extending through its center, while simultaneously revolving about axis Y, which extends through the center of the crank 162. Thus the rotating knife bar 164 moves along the circumference of a circle (having axis Y as its center) from its normal or retracted position to its engage or cut position (indicated by the dot-dash lines), at which point the blade 168 severs the web 150. The bar 164 then continues along the circumference of the circle to its retracted position causing the brush 170 to engage the tail 172. For this flying transfer operation the blade 168 is driven to produce a blade edge speed greater than the linear speed of the web 150. The blade cuts the web between the core and winding roll creating a trailing edge which continues to the full roll and a tail 172 (the leading edge) which is moved into engagement with the new core 158 by the sweeping action of the brush 170. The tail 172 adheres to the new core to begin the new winding roll.

Referring now to FIG. 5, a die-cut transfer system for use in a winding application also employs a rotary knife. In the system a web 120 is passed around a stationary guide roll 122 and a movable bumper roll 124 to a winding roll, not shown. A new core 126 which may, for example, be formed with a soft outer surface layer 128, is prepared for transfer and disposed below the web 120. Our rotary cutoff knife, indicated generally by the reference character 130, is disposed above the web 120.

As more fully described above, our knife 130 includes a crank 132 upon which a knife bar 134 is mounted and an internal ring gear 136 which is adapted to rotate the knife bar 134 on an axis A extending through its center. For die-cut operations the knife bar 134 may, for example, carry a steel rule type die using the core 126 as a platen or a serrated blade 138, as shown, adapted to cut into and against a "soft" (outer surface 128) core. The crank 132 and ring gear 136 are adapted to be simultaneously rotated by respective belts 140 and 142 which are driven by pulleys 144 and 145 mounted on a shaft 146 connected to a suitable motor (not shown).

At the time of transfer, when the winding roll is full, the new core 126 is accelerated to match the speed of the web 120 and the bumper roll 124 is fired, moving from its normal position to the position indicated by the dot-dash line, to bring the web 120 (indicated by the dot-dash line) into contact with the core 126. The rotary knife motor is energized, driving belts 140 and 142 to simultaneously rotate both the crank 132 and the internal ring gear 136.

In response, knife bar 134 begins to rotate on axis A while simultaneously revolving about axis B which extends through the center of the crank 132. Thus the rotating knife bar 134 moves along the circumference of a circle (having axis B as its center) from its normal or retracted position to its engage or cut position (indicated by the dot-dash lines), at which point the blade 138 severs the web 120, and then back to its retracted position completing the circle. For this die-cut operation, the blade 138 and the new core 126 are driven to produce a blade edge speed and a core surface speed both of which are equal to the linear speed of the web 120. The blade 138 actually passes through the web 120 creating a trailing edge which continues to the full roll and a leading edge which remains on the new core 126 to begin the new roll. Because the blade 138 is moving at the same surface speed as the core 126, the penetration produces a clean slit with no gouging, thereby preventing excessive core wear.

In addition to its use in winding and winding operations, our rotary knife is also well suited for use in butt splicing when it is objectionable to have an overlapping section pass through the process. In one method of butt splicing a lap splice is made and then removed and the two ends are butted together at line speed. In this application the knife is used in conjunction with a rubber roll which it penetrates, thereby assuring a complete cutoff at a known location. After the tail is stripped away, a similar device may apply tape to the two butted ends of the new and expiring webs.

Referring now to FIG. 7, we have shown an alternate embodiment of our invention in which the knife bar 182 supports a knife blade 184 supported on bar 182 in a suitable manner such that the edge of the blade 184 lies along the locus of a spiral. It will readily be appreciated that this knife can make a cut which is not perpendicular to the direction of web travel as in the butt splicing operation discussed immediately hereinabove. This is desirable in order to ease the stress on the splice as it moves through the system. The pitch of the spiral is determined by the speed of cutting and other considerations.

It will be seen that we have accomplished the objects of our invention. We have provided a rotary cutoff knife which overcomes the defects of those of the prior art. Our knife is smaller than those of the prior art, and does not require large drive motor and transmission components. In addition, the power necessary to accelerate our knife from a position of rest to the engaged or cut position is reduced, as compared to the power required by knives of the prior art. Our rotary knife is adapted to cut against a soft core without gouging. One embodiment of our knife is capable of making a cut which is not perpendicular to the direction of movement of the sheet.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An improved rotary knife assembly for severing a moving web including in combination, means for moving a web along path, a support, a crank member, means mounting said crank member on said support for rotary movement around a first axis from a first position remote from said web path to a second position adjacent to said web path, a knife bar, a knife on said bar, means mounting said knife bar on said crank member for rotary movement around a second axis parallel to and spaced from said first axis, first means for rotating said crank at a certain rate in the course of a web severing operation to move the crank member from the first position to the second position, and second means for concomitantly rotating said knife bar over the course of movement of the crank member from said first position to said second position during a severing operation to bring said knife up to at least web speed.

2. An improved rotary knife assembly as in claim 1 in which said knife blade is driven through said second position at a rate whereby the speed of the cutting edge of the blade is equal to the linear speed of the web.

3. An improved rotary knife assembly as in claim 1 in which said knife blade is driven through said second position at a rate whereby the speed of the cutting edge of the blade is greater than the linear speed of the web.

4. An improved rotary knife assembly for severing a moving web including in combination, means for moving a web along a path, a support, a crank member, means mounting said crank member on said support for rotary movement around a first axis from a first position remote from said web path to a second position adjacent to said web path, a knife bar, a knife on said bar, means mounting said knife bar on said crank member for rotary movement around a second axis parallel to and spaced from said first axis, a drive member, means mounting said drive member on said crank member for rotary movement around said first axis, a drive coupling said drive member to said knife bar, first means for rotating said crank at a certain rate in the course of a web severing operation to move the crank member from the first position to the second position, and second means for concomitantly rotating said knife bar in the course of a severing operation at a rate greater than said certain rate to bring said knife up to at least web speed as said crank member moves from said first position to said second position.

5. An improved rotary knife assembly as in claim 4 in which said drive coupling comprises a pinion coupled to the knife bar for movement therewith and ring gear on said drive member.

6. An improved rotary knife assembly as in claim 4 in which said drive coupling comprises a pinion, means mounting said pinion on said crank member for rotary movement around said second axis, a flexible coupling connecting said pinion to said knife bar, and a ring gear in engagement with said pinion carried by said drive member.

* * * * *